US009151174B2

(12) United States Patent
Chouhan

(10) Patent No.: US 9,151,174 B2
(45) Date of Patent: Oct. 6, 2015

(54) SEALING ASSEMBLY FOR USE IN A ROTARY MACHINE AND METHODS FOR ASSEMBLING A ROTARY MACHINE

(75) Inventor: Rohit Chouhan, Bangalore (IN)

(73) Assignee: General Electric Company, Schenectady, NY (US)

( * ) Notice: Subject to any disclaimer, the term of this patent is extended or adjusted under 35 U.S.C. 154(b) by 580 days.

(21) Appl. No.: 13/416,875

(22) Filed: Mar. 9, 2012

(65) Prior Publication Data

US 2013/0236298 A1 Sep. 12, 2013

(51) Int. Cl.
*F01D 11/02* (2006.01)
*F01D 11/08* (2006.01)

(52) U.S. Cl.
CPC ..... *F01D 11/02* (2013.01); *F01D 11/08* (2013.01); *Y10T 29/49321* (2015.01); *Y10T 29/49323* (2015.01)

(58) Field of Classification Search
CPC ..... F01D 11/08; F01D 11/02
USPC ..... 415/170.1, 173.1, 173.3; 29/889.21, 29/889.22
See application file for complete search history.

(56) References Cited

U.S. PATENT DOCUMENTS

| | | | | |
|---|---|---|---|---|
| 3,042,365 | A * | 7/1962 | Curtis et al. | 415/173.4 |
| 5,749,584 | A | 5/1998 | Skinner et al. | |
| 6,131,910 | A | 10/2000 | Bagepalli et al. | |
| 6,257,586 | B1 | 7/2001 | Skinner et al. | |
| 6,547,522 | B2 * | 4/2003 | Turnquist et al. | 415/173.3 |
| 6,779,799 | B2 | 8/2004 | Tong et al. | |
| 7,686,568 | B2 * | 3/2010 | Moors et al. | 415/1 |
| 7,857,582 | B2 | 12/2010 | Kovac et al. | |
| 7,938,402 | B2 | 5/2011 | Garrison et al. | |
| 7,971,882 | B1 * | 7/2011 | Liang | 277/418 |
| 8,074,997 | B2 | 12/2011 | Garrison et al. | |
| 2004/0151582 | A1 * | 8/2004 | Faulkner | 415/173.1 |
| 2004/0239040 | A1 | 12/2004 | Burdgick | |
| 2006/0228209 | A1 * | 10/2006 | Couture et al. | 415/174.2 |
| 2008/0075600 | A1 | 3/2008 | Moors | |
| 2011/0085893 | A1 * | 4/2011 | Jain et al. | 415/173.4 |
| 2011/0299984 | A1 | 12/2011 | Garrison | |

FOREIGN PATENT DOCUMENTS

| | | | |
|---|---|---|---|
| EP | 1270876 | A2 | 1/2003 |
| EP | 1712743 | A2 | 10/2006 |

OTHER PUBLICATIONS

Search Report and Written from corresponding EP Application No. 13157854.4, dated Jun. 14, 2013.

* cited by examiner

*Primary Examiner* — Craig Kim
*Assistant Examiner* — Brian P Wolcott
(74) *Attorney, Agent, or Firm* — Armstrong Teasdale LLP

(57) ABSTRACT

A sealing assembly for use with a rotary machine is described herein. The sealing assembly includes a stator shroud coupled to the casing. The stator shroud includes an inner surface that at least partially defines the cavity within the casing. At least one stator labyrinth tooth extends outwardly from the stator shroud inner surface towards a rotor assembly positioned within the casing. At least one protective member is coupled to the stator shroud upstream from the at least one stator labyrinth tooth to facilitate reducing a flow of combustion gas across the at least one stator labyrinth tooth.

20 Claims, 5 Drawing Sheets

SEALING ASSEMBLY FOR USE IN A ROTARY MACHINE AND METHODS FOR ASSEMBLING A ROTARY MACHINE

BACKGROUND OF THE INVENTION

The subject matter described herein relates generally to rotary machines and more particularly, to a sealing assembly and methods of assembling a rotary machine.

At least some known turbomachines such as, for example, gas turbine engines include a combustor, a compressor coupled downstream from the combustor, a turbine, and a rotor assembly rotatably coupled between the compressor and the turbine. Some known rotor assemblies include a rotor shaft, at least one rotor disk coupled to the rotor shaft, and a plurality of circumferentially-spaced turbine buckets that extend outwardly from each rotor disk. Each turbine bucket includes an airfoil that extends radially outward from a platform towards a turbine casing.

During operation of at least some known turbines, the compressor compresses air that is subsequently mixed with fuel prior to being channeled to the combustor. The mixture is then ignited to generate hot combustion gases that are channeled to the turbine. The rotating turbine blades or buckets channel high-temperature fluids, such as combustion gases, through the turbine. The turbine extracts energy from the combustion gases for powering the compressor, as well as producing useful work to power a load, such as an electrical generator, or to propel an aircraft in flight.

At least some known turbine engines include a sealing assembly that includes a plurality of stator labyrinth teeth that extend outwardly from a turbine casing towards each turbine bucket to reduce air leakage/air flow between the airfoil and the turbine casing. At least a portion of combustion gases channeled through the turbine are undesirably channeled between a tip end of the turbine bucket and the turbine casing as tip clearance losses. Over time, the labyrinth teeth may begin to oxidize and/or wear as the combustion gases contact the labyrinth teeth, which may increase tip clearance losses and/or reduce an operating efficiency of the turbine.

BRIEF DESCRIPTION OF THE INVENTION

In one aspect, a sealing assembly for use with a rotary machine is provided. The sealing assembly includes a stator shroud coupled to a casing within the rotary machine. The stator shroud includes an inner surface that at least partially defines a cavity within the casing. At least one stator labyrinth tooth extends outwardly from the stator shroud inner surface towards a rotor assembly positioned within the casing. At least one protective member is coupled to the stator shroud upstream from the at least one stator labyrinth tooth to facilitate reducing a flow of combustion gas across the at least one stator labyrinth tooth.

In another aspect, a rotary machine is provided. The rotary machine includes a sealing assembly oriented between the stator casing and the rotor assembly. The sealing assembly includes a stator shroud that is coupled to the stator casing within the rotary machine. The stator shroud includes an inner surface that at least partially defines the cavity positioned within the casing. At least one stator labyrinth tooth extends outwardly from the stator shroud inner surface towards the rotor assembly and is positioned within the casing. At least one protective member is coupled to the stator shroud upstream from the stator labyrinth tooth to facilitate reducing a flow of combustion gas across the stator labyrinth tooth.

In a further aspect, a method of assembling a rotary machine is provided. The method includes coupling a rotor within the stator casing. A stator shroud is coupled to the stator casing supporting the rotor. The stator shroud includes at least one stator labyrinth tooth that extends outwardly from the stator shroud towards the rotor assembly. At least one protective member is coupled to the stator shroud inner surface upstream from the at least one stator labyrinth tooth to facilitate reducing a flow of combustion gas across the stator labyrinth tooth during rotor operation.

DETAILED DESCRIPTION OF THE INVENTION

The exemplary methods and systems described herein overcome at least some disadvantages of known turbomachines by providing a sealing assembly that includes a protective member that is upstream from a labyrinth tooth to facilitate reducing oxidation of the labyrinth tooth during operation. More specifically, the protective member is positioned adjacent to an upstream surface of the labyrinth tooth to prevent combustion gases from contacting the upstream surface of the tooth. The protective member extends across a full height of the labyrinth tooth such that combustion gases are substantially prevented from contacting the labyrinth tooth to facilitate reducing an oxidation of the labyrinth tooth.

As used herein, the term "upstream" refers to a forward or inlet end of a rotary machine, and the term "downstream" refers to an aft or discharge end of the rotary machine.

Figure 1:
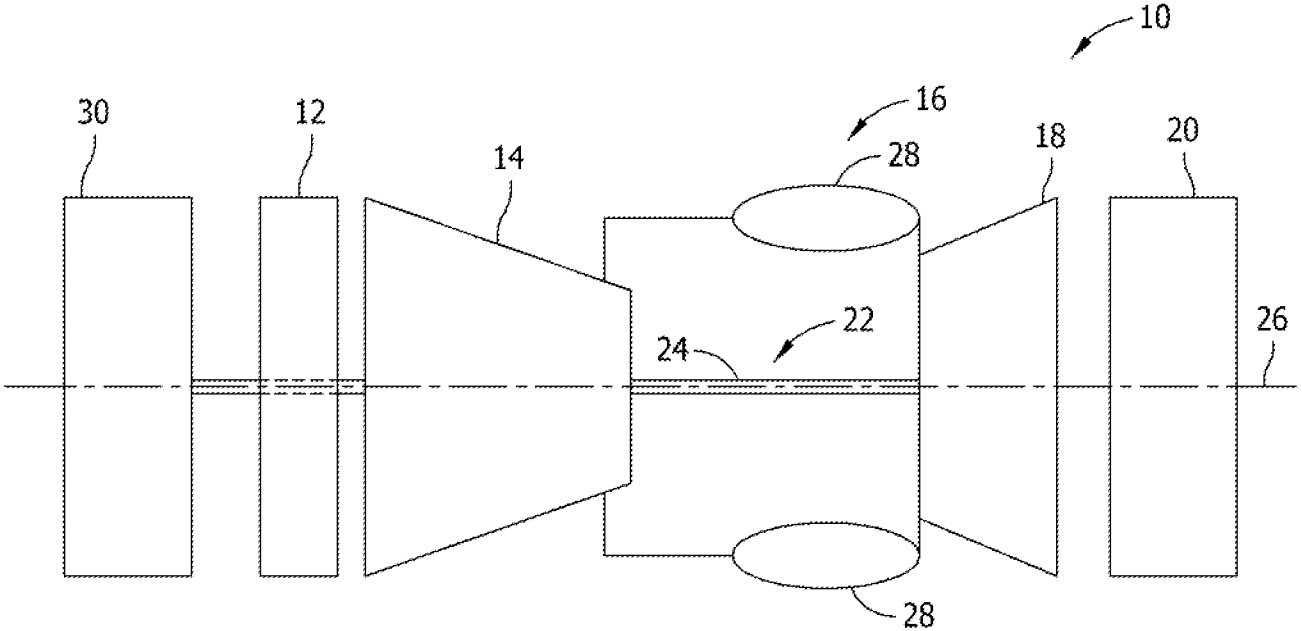
FIG. 1 is a schematic view of an exemplary turbine engine.

FIG. 1 is a schematic view of an exemplary turbine engine system 10. In the exemplary embodiment, turbine engine system 10 includes an intake section 12, a compressor section 14 that is downstream from intake section 12, a combustor section 16 that is downstream from compressor section 14, a turbine section 18 that is downstream from combustor section 16, and an exhaust section 20 that is downstream from turbine section 18. Turbine section 18 is coupled to compressor section 14 via a rotor assembly 22. Rotor assembly 22 includes a rotor shaft 24 that extends along a centerline axis 26, and is coupled to turbine section 18 and compressor section 14. In the exemplary embodiment, combustor section 16 includes a plurality of combustors 28. Combustor section 16 is coupled to compressor section 14 such that each combustor 28 is in flow communication with compressor section 14. Combustor section 16 is also coupled to turbine section 18 for channeling a working fluid towards turbine section 18. Turbine section 18 is also coupled to a load 30 such as, but not limited to, an electrical generator and/or a mechanical drive application.

During operation, intake section 12 channels air towards compressor section 14 wherein the air is compressed to a higher pressure and temperature prior to being discharged towards combustor section 16. Combustor section 16 mixes the compressed air with fuel, ignites the fuel-air mixture to generate a working fluid such as, for example, combustion gases, and channels the combustion gases towards turbine section 18. More specifically, in each combustor 28, fuel, for example, natural gas and/or fuel oil, is injected into the air flow, and the fuel-air mixture is ignited to generate high temperature combustion gases that are channeled towards turbine section 18. Turbine section 18 converts thermal energy from the gas stream to mechanical rotational energy as the combustion gases impart rotational energy to turbine section 18 and to rotor assembly 22.

Figure 2:
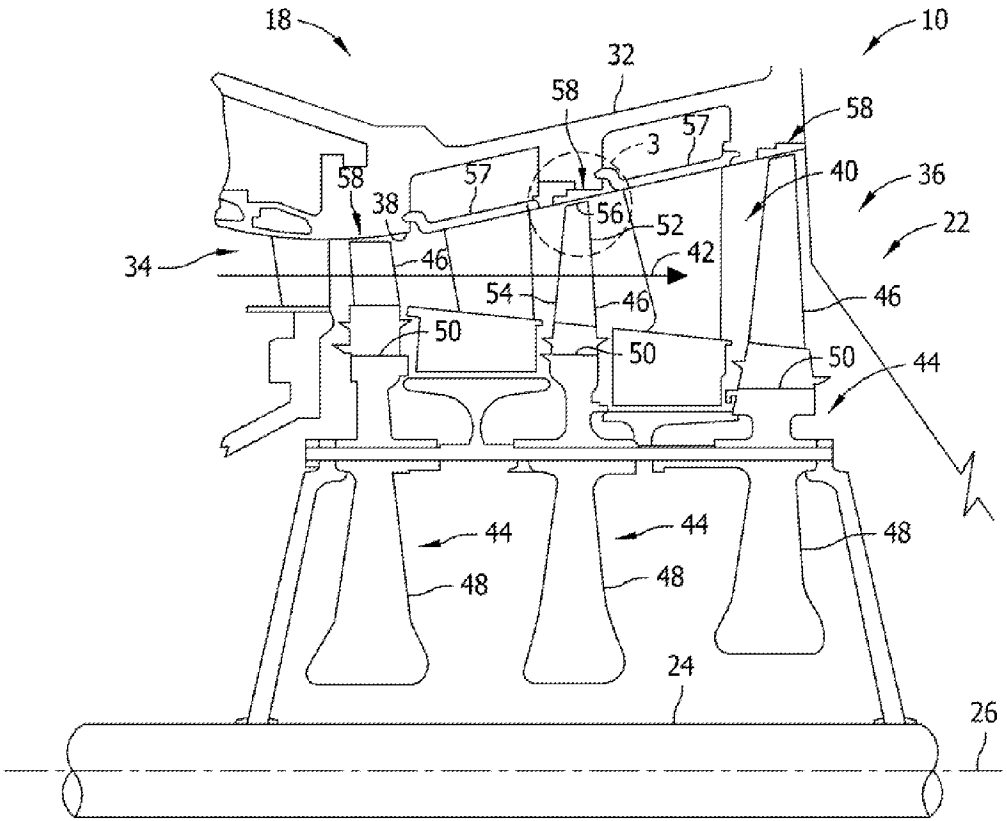
FIG. 2 is a partial sectional view of a portion of an exemplary rotor assembly that may be used with the turbine engine shown in FIG. 1.
Figure 3:
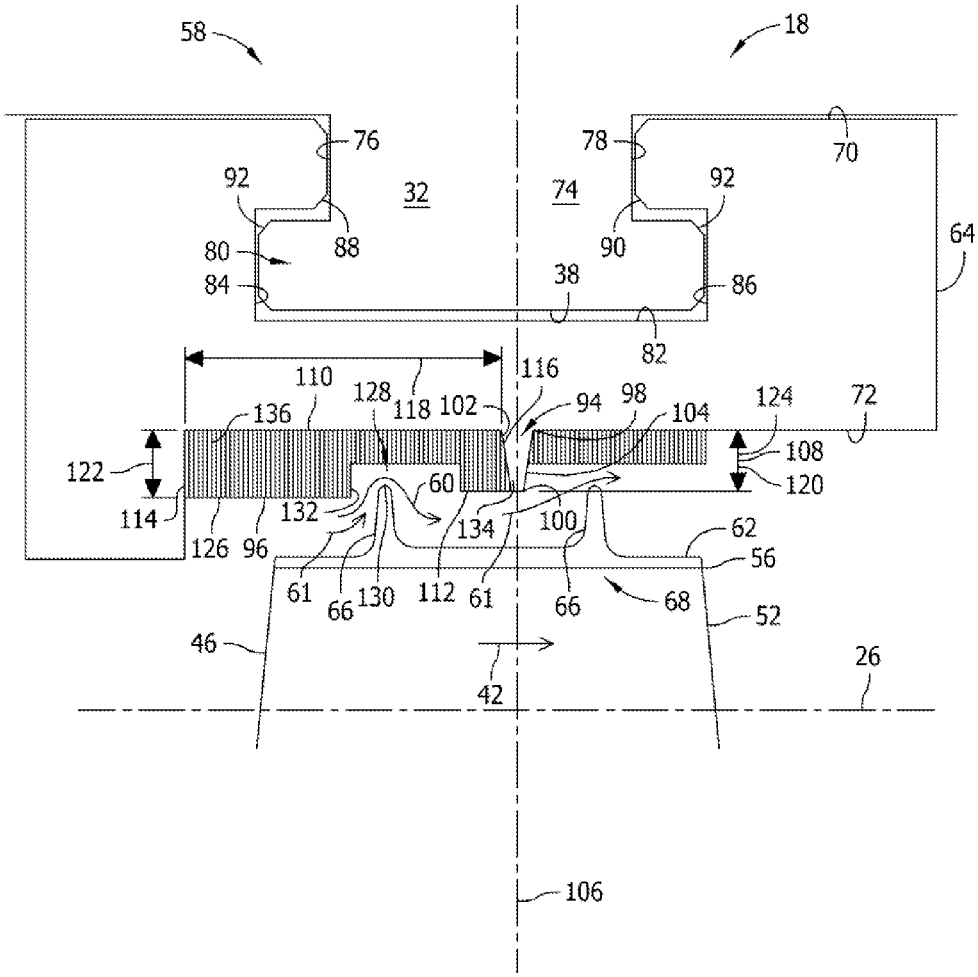
FIG. 3 is an enlarged partial sectional view of a portion of the rotor assembly shown in FIG. 2, taken along area 3, and including an exemplary sealing assembly.

FIG. 2 is a partial sectional view of a portion of rotor assembly 22. FIG. 3 is an enlarged partial sectional view of a portion of rotor assembly 22 taken along area 3. In the exemplary embodiment, turbine section 18 includes a stator casing 32 that includes a fluid inlet 34, a fluid outlet 36, and an inner surface 38 that defines a cavity 40 that extends between fluid inlet 34 and fluid outlet 36. Rotor assembly 22 is positioned within stator casing 32 such that a combustion gas path, represented by arrow 42, is defined between casing inner surface 38 and rotor assembly 22. Rotor assembly 22 includes a plurality of turbine bucket assemblies 44 that are coupled to rotor shaft 24, and that extend between fluid inlet 34 and fluid outlet 36. Each turbine bucket assembly 44 includes a plurality of turbine buckets 46 that extend radially outwardly from a rotor disk 48. Each rotor disk 48 is coupled to rotor shaft 24, and rotates about centerline axis 26. In the exemplary embodiment, each turbine bucket 46 is coupled to an outer surface 50 of rotor disk 48, and is spaced circumferentially about rotor disk 48 such that combustion gas path 42 is defined between stator casing 32 and each rotor disk 48. Each turbine bucket 46 extends at least partially through a portion of combustion gas path 42, and includes an airfoil 52 that extends radially outwardly from rotor disk 48 towards casing inner surface 38. Airfoil 52 extends between a root end 54 and a tip end 56. Root end 54 is coupled to rotor disk 48. Tip end 56 extends outwardly from root end 54 towards stator casing 32. Turbine section 18 also includes a plurality of stator vane assemblies 57 that are coupled to casing 32 and extend circumferentially about rotor shaft 24. Each stator vane assembly 57 is oriented between adjacent turbine bucket assemblies 44 for channeling combustion gases downstream towards a corresponding turbine bucket assembly 44.

In the exemplary embodiment, turbine section 18 includes a plurality of sealing assemblies 58 that are each oriented between a turbine bucket 46 and stator casing 32 such that a tortuous path, represented by arrow 60, is formed between stator casing 32 and turbine bucket tip end 56 to facilitate reducing working fluid leakage, represented by arrow 61, between stator casing 32 and turbine bucket 46. Sealing assembly 58 extends circumferentially about rotor assembly 22, and includes a tip shroud 62, and a stator shroud 64 that is oriented with respect to tip shroud 62 such that tortuous path 60 is defined between stator shroud 64 and tip shroud 62. Tip shroud 62 is coupled to turbine bucket tip end 56 and extends radially outwardly from turbine bucket 46 towards stator casing 32. Tip shroud 62 includes at least one rotor labyrinth tooth 66 that extends outwardly from turbine bucket 46 towards stator casing 32. Each rotor labyrinth tooth 66 extends at least partially through a portion of tortuous path 60. In the exemplary embodiment, tip shroud 62 includes a pair 68 of axially-spaced rotor labyrinth teeth 66.

Stator shroud 64 is coupled to casing inner surface 38 and extends radially inwardly from stator casing 32 towards rotor assembly 22 such that stator shroud 64 is oriented circumferentially about rotor assembly 22. Stator shroud 64 extends between a radially outer surface 70 and a radially inner surface 72. Stator casing 32 includes a projection 74 that extends outwardly from casing inner surface 38. Projection 74 extends between an upstream surface 76 and a downstream surface 78 along centerline axis 26, and is oriented circumferentially about rotor assembly 22. Stator shroud 64 includes a dovetail groove 80 that is defined within stator shroud outer surface 70, and is sized and shaped to receive casing projection 74 therein to couple stator shroud 64 to stator casing 32.

Stator shroud groove 80 is defined by an interior surface 82 that extends between a first axial inner surface 84 and a second axial inner surface 86 along centerline axis 26. First and second axial surfaces 84 and 86 extend radially inwardly from shroud outer surface 70 to interior surface 82. In the exemplary embodiment, stator shroud 64 includes a first bearing hook 88 and a second bearing hook 90. Each bearing hook 88 and 90 facilitates preventing stator shroud 64 from moving radially outwardly with respect to stator casing 32. More specifically, first bearing hook 88 extends outwardly from first axial inner surface 84 towards upstream surface 76, and second bearing hook 90 extends outwardly from second axial inner surface 86 towards downstream surface 78. Projection 74 includes a pair of bearing flanges 92 that extend outwardly from upstream surface 76 and downstream surface 78, respectively. Each bearing flange 92 is oriented to engage respective bearing hooks 88 and 90 to facilitate securely coupling stator shroud 64 to stator casing 32.

In the exemplary embodiment, sealing assembly 58 also includes at least one stator labyrinth tooth 94, and at least one protective member 96 that is positioned adjacent to stator labyrinth tooth 94. Stator labyrinth tooth 94 and protective member 96 each extend circumferentially about rotor assembly 22, and each extend outwardly from stator shroud inner surface 72 towards the rotor assembly 22. Stator labyrinth tooth 94 extends at least partially through a portion of tortuous path 60, and is oriented between adjacent rotor labyrinth teeth 66. Stator labyrinth tooth 94 includes a base end 98, a tip end 100, an upstream surface 102, and a downstream surface 104. Each upstream surface 102 and downstream surface 104 extends between base end 98 and tip end 100. Downstream surface 104 is axially-spaced from upstream surface 102 along centerline axis 26. Base end 98 is oriented adjacent to stator shroud inner surface 72. Tip end 100 extends outwardly from base end 98 towards rotor assembly 22 along a radial axis 106 such that stator labyrinth tooth 94 includes a height 108 measured between base end 98 and tip end 100. In the exemplary embodiment, stator labyrinth tooth 94 is formed unitarily with stator shroud 64. Alternatively, stator labyrinth tooth 94 may be coupled to stator shroud 64.

Protective member 96 is coupled to stator shroud 64, and is upstream from stator labyrinth tooth 94 to facilitate reducing a flow of combustion gas across stator labyrinth tooth 94. In the exemplary embodiment, protective member 96 includes a base portion 110, a tip portion 112, an upstream side surface 114, and a downstream side surface 116. Base portion 110 and tip portion 112 each extend between upstream side surface 114 and downstream side surface 116 along centerline axis 26 such that protective member 96 includes a width 118 measured between upstream side surface 114 and downstream side surface 116. Base portion 110 is coupled to stator shroud inner surface 72. Tip portion 112 extends outwardly from base portion 110 towards rotor assembly 22 such that protective member 96 has a height 120 measured between base portion 110 and tip portion 112 along radial axis 106. Side surfaces 114 and 116 each extend between base portion 110 and tip portion 112. Upstream side surface 114 includes a first height 122 measured between base portion 110 and tip portion 112 along radial axis 106, and downstream side surface 116 includes a second height 124 measured between base portion 110 and tip portion 112. In the exemplary embodiment, upstream side surface height 122 is greater than downstream side surface height 124. Alternatively, upstream side surface height 122 may be shorter than, or approximately equal to downstream side surface height 124.

Protective member 96 is oriented with respect to stator labyrinth tooth 94 such that protective member 96 is adjacent to stator labyrinth tooth upstream surface 102. More specifically, protective member 96 is oriented such that protective member downstream side surface 116 is adjacent to stator labyrinth tooth upstream surface 102 such that downstream side surface 116 extends across upstream surface 102 to facilitate preventing combustion gases 61 from contacting upstream surface 102. In the exemplary embodiment, downstream side surface height 124 is approximately equal to stator labyrinth tooth height 108 such that downstream side surface 116 extends across a full height 108 of stator labyrinth tooth 94. Alternatively, downstream side surface height 124 may be shorter than, taller than, or greater than stator labyrinth tooth height 108. In an alternative embodiment, protective member 96 may extend across stator labyrinth tooth 94 such that stator labyrinth tooth 94 is encapsulated within protective member 96.

In the exemplary embodiment, protective member tip portion 112 includes a tip surface 126 that extends between upstream side surface 114 and downstream side surface 116. Protective member 96 includes a groove 128 that is defined within tip surface 126, and that extends circumferentially about rotor assembly 22. Groove 128 is sized and shaped to receive at least a portion of rotor labyrinth tooth 66 therein. More specifically, protective member 96 is oriented with respect to rotor labyrinth tooth 66 such that a tip end 130 of rotor labyrinth tooth 66 is oriented within at least a portion of groove 128. In one embodiment, protective member 96 is a honeycombed material. In the exemplary embodiment, protective member 96 includes a layer 132 of abradable material such as, for example a honeycombed material. Abradable layer 132 is oriented adjacent to rotor labyrinth tooth 66 such that rotor labyrinth tooth tip end 130 contacts at least a portion of abradable layer 132 such that a portion of abradable layer 132 is removed during rotation of rotor assembly 22 to form groove 128 as turbine bucket 46 thermally expands.

In the exemplary embodiment, stator labyrinth tooth 94 includes a first substrate material 134, and protective member 96 includes a second substrate material 136 that is different than first substrate material 134. More specifically, protective member substrate material 136 has an oxidation resistance that is greater than an oxidation resistance of stator tooth substrate material 134 such that, during operation, stator labyrinth tooth 94 oxidizes at a rate that is greater than an oxidation rate of protective member 96. In addition, protective member substrate material 136 includes a temperature resistance that is greater than a temperature resistance of stator tooth substrate material 134. By orienting protective member 96 upstream of stator labyrinth tooth 94, such that a portion of protective member 96 is between stator labyrinth tooth 94 and combustion gases, oxidation of stator labyrinth tooth 94 is facilitated to be reduced because contact between combustion gases 61 and stator labyrinth tooth 94 is reduced.

Figure 4:
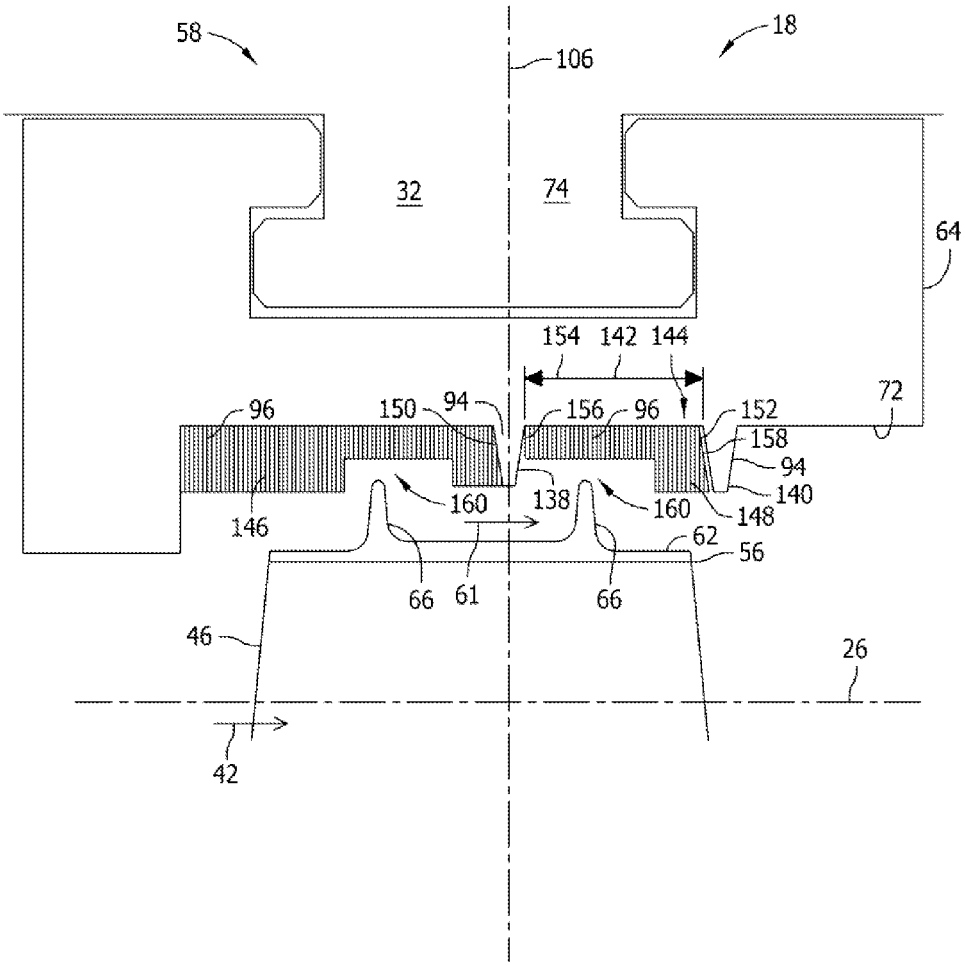
FIGS. 4 and 5 are enlarged partial sectional views of alternative embodiments of the sealing assembly shown in FIG. 3.
Figure 5:
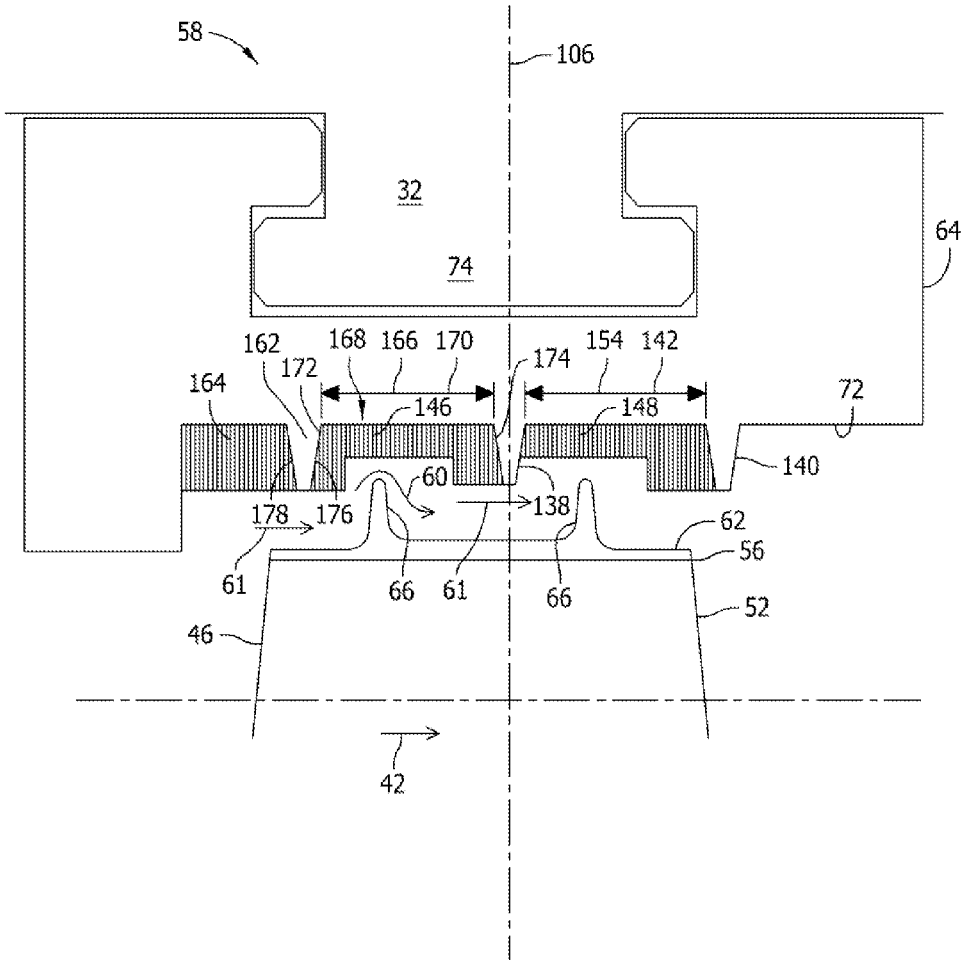

FIGS. 4 and 5 are enlarged partial sectional views of alternative embodiments of sealing assembly 58. Identical components shown in FIGS. 4 and 5 are labeled with the same reference numbers used in FIG. 3. In an alternative embodiment, sealing assembly 58 includes a plurality of stator labyrinth teeth 94 that each extend outwardly from stator shroud inner surface 72, and a plurality of protective members 96 that are each coupled to stator shroud 64. Each protective member 96 is upstream from a corresponding stator labyrinth tooth 94 to prevent combustion gases 61 from contacting each stator labyrinth tooth 94. Referring to FIG. 4, in one embodiment, sealing assembly 58 includes a first stator labyrinth tooth 138 and a second stator labyrinth tooth 140 oriented downstream from first stator labyrinth tooth 138. First stator labyrinth tooth 138 is oriented between adjacent rotor labyrinth teeth 66. Second stator labyrinth tooth 140 is downstream from rotor labyrinth teeth 66 and is axially-spaced a distance 142 from first stator labyrinth tooth 138 such that a first gap 144 is defined between first and second stator labyrinth teeth 138 and 140.

Sealing assembly 58 also includes a first protective member 146 and a second protective member 148. First protective member 146 is upstream from first stator labyrinth tooth 138, and is positioned adjacent to first stator labyrinth tooth 138 to prevent combustion gases 61 from contacting an upstream surface 150 of first stator labyrinth tooth 138. Second protective member 148 is between first stator labyrinth tooth 138 and second stator labyrinth tooth 140, and is positioned adjacent to second stator labyrinth tooth 140 to prevent combustion gases 61 from contacting an upstream surface 152 of second stator labyrinth tooth 140. Second protective member 148 has a width 154 measured between an upstream side surface 156 and a downstream side surface 158 that is approximately equal to distance 142 such that second protective member 148 extends across first gap 144. First and second protective members 146 and 148 each include a groove 160 that is sized and shaped to receive a corresponding rotor labyrinth tooth 66 therein.

Referring to FIG. 5, in one embodiment, sealing assembly 58 includes a third stator labyrinth tooth 162 and a third protective member 164. Third stator labyrinth tooth 162 is upstream from first stator labyrinth tooth 138, and is spaced a distance 166 upstream from first stator labyrinth tooth 138 such that a second gap 168 is defined between first stator labyrinth tooth 138 and third stator labyrinth tooth 162. Third stator labyrinth tooth 162 is also upstream from rotor labyrinth teeth 66. In the exemplary embodiment, first protective member 146 extends between first stator labyrinth tooth 138 and third stator labyrinth tooth 162, and has a width 170 measured between an upstream side surface 172 and a downstream side surface 174 that is approximately equal to distance 166. As such, first protective member 146 extends across second gap 168 such that upstream side surface 172 is adjacent to a downstream surface 176 of third stator labyrinth tooth 162. Third protective member 164 is upstream from third stator labyrinth tooth 162, and is positioned adjacent to an upstream surface 178 of third stator labyrinth tooth 162 to facilitate preventing combustion gases 61 from contacting third stator tooth upstream surface 178.

The size, shape, and orientation of protective member 96 is selected to facilitate reducing an oxidation of stator labyrinth tooth 94 during operation of turbine engine 10. Moreover, the size, shape, and orientation of protective member 96 is selected to reduce direct contact between combustion gases and stator tooth upstream surface 102. By reducing direct contact between combustion gases and stator labyrinth tooth 94, an oxidation and wear of stator labyrinth tooth 94 is reduced, such that the useful life of sealing assembly 58 is increased.

The above-described sealing assembly overcomes at least some disadvantages of known turbomachines by providing a sealing assembly that includes a protective member that is upstream from a labyrinth tooth to facilitate reducing oxidation of the labyrinth tooth during operation. More specifically, the sealing assembly includes a protective member that is adjacent to an upstream surface of the labyrinth tooth to prevent combustion gases from contacting the upstream surface. By providing a protective member that extends across a full height of the labyrinth tooth, combustion gases are prevented from contacting the labyrinth tooth and oxidation of the labyrinth tooth is reduced. As such, losses in gas energy are reduced and the useful life of the turbine engine is increased.

Exemplary embodiments of a sealing assembly for use with rotary machines and methods of assembling a rotary machine are described above in detail. The sealing assemblies described herein are not limited to the specific embodiments described herein, but rather, components of the sealing assemblies may be utilized independently and separately from other components described herein. For example, the sealing assemblies may be used in combination with other rotary machines, and are not limited to being used with only the rotary machine and operations thereof, as described herein. Rather, the sealing assembly can be implemented and utilized in connection with many other sealing applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sealing assembly for use with a rotary machine, said sealing assembly comprising:

a stator shroud coupled to a casing within the rotary machine, said stator shroud comprising an inner surface that at least partially defines a cavity within the casing;

at least one stator labyrinth tooth extending from said stator shroud inner surface and circumscribing a rotor assembly positioned within the casing, said at least one stator labyrinth tooth comprises a base portion, a tip portion extending radially inwardly from said base portion towards the rotor assembly, and an upstream surface that extends between said base and tip portions; and at least one protective member coupled to said stator shroud, said protective member positioned upstream from said at least one stator labyrinth tooth such that a downstream side of said at least one protective member extends across substantially all of said upstream surface of said at least one stator labyrinth tooth to facilitate reducing a flow of combustion gas across said at least one stator labyrinth tooth.

2. A sealing assembly in accordance with claim 1, wherein said downstream side of said at least one protective member defines a second height, said at least one protective member further comprises an upstream side that defines a first height that is different from the second height, and wherein the second height is approximately equal to a height of said at least one stator labyrinth tooth.

3. A sealing assembly in accordance with claim 1, wherein said at least one stator labyrinth tooth comprises a plurality of stator labyrinth teeth extending outwardly from said stator shroud inner surface, wherein said at least one protective member comprises a plurality of protective members coupled to said stator shroud, each of said plurality of protective members is upstream from a corresponding one of said plurality of stator labyrinth teeth.

4. A sealing assembly in accordance with claim 3, wherein said plurality of stator labyrinth teeth are oriented with respect to the rotor assembly such that a tortuous gas path is defined between said plurality of stator labyrinth teeth and a portion of the rotor assembly.

5. A sealing assembly in accordance with claim 4, wherein said sealing assembly further comprises a plurality of rotor labyrinth teeth, each of said plurality of stator labyrinth teeth are positioned between adjacent parts of said plurality of rotor labyrinth teeth.

6. A sealing assembly in accordance with claim 4, wherein said protective member comprises an abradable material, each of said plurality of rotor labyrinth teeth are oriented to contact at least a portion of said abradable material during rotation of the rotor assembly.

7. A sealing assembly in accordance with claim 1, wherein said at least one stator labyrinth tooth comprises a first substrate material, said at least one protective member comprises a second substrate material that is different than said first substrate material.

8. A rotary machine comprising:

a stator casing comprising an inner surface that defines a cavity therein;

a rotor assembly coupled within said stator casing cavity; and a sealing assembly between said stator casing and said rotor assembly, said sealing assembly comprising:

a stator shroud coupled to said stator casing;

at least one stator labyrinth tooth extending from said stator shroud and circumscribing said rotor assembly, said at least one stator labyrinth tooth comprises a base portion, a tip portion extending radially inwardly from said base portion towards said rotor assembly, and an upstream surface that extends between said base and tip portions; and at least one protective member coupled to said stator shroud, said protective member positioned upstream from said at least one stator labyrinth tooth such that a downstream side of said at least one protective member extends across substantially all of said upstream surface of said at least one stator labyrinth tooth to facilitate reducing a flow of combustion gas across said at least one stator labyrinth tooth.

9. A rotary machine in accordance with claim 8, wherein said downstream side of said at least one protective member defines a second height, said at least one protective member further comprises an upstream side that defines a first height that is different from the second height, and wherein the second height is approximately equal to a height of said stator labyrinth tooth.

10. A rotary machine in accordance with claim 8, wherein said at least one protective member comprises a plurality of protective members coupled to said stator shroud, each of said plurality of protective members is upstream from a corresponding stator labyrinth tooth.

11. A rotary machine in accordance with claim 8, wherein said at least one stator labyrinth tooth comprises a first substrate material, said at least one protective member comprises a second substrate material that is different than said first substrate material.

12. A rotary machine in accordance with claim 8, wherein said sealing assembly further comprises at least one rotor labyrinth tooth extending outwardly from said rotor assembly towards said stator casing, said at least one stator labyrinth tooth oriented such that a tortuous gas path is defined between said at least one stator labyrinth tooth and said at least one rotor labyrinth tooth.

13. A rotary machine in accordance with claim 12, wherein said at least one stator labyrinth tooth is positioned between an adjacent pair of said rotor labyrinth teeth.

14. A rotary machine in accordance with claim 12, wherein said protective member comprises an abradable material, said at least one rotor labyrinth tooth is oriented to contact at least a portion of said abradable material during rotation of the rotor assembly.

15. A method of assembling a rotary machine, said method comprising:

coupling a rotor within a stator casing;

coupling a stator shroud to the stator casing supporting the rotor, wherein the stator shroud includes at least one stator labyrinth tooth that extends from an inner surface of the stator shroud and circumscribes the rotor assembly, the at least one stator labyrinth tooth comprises a base portion, a tip portion extending radially inwardly from the base portion towards the rotor assembly, and an upstream surface that extends between the base and tip portions; and coupling at least one protective member to the stator shroud inner surface, wherein the at least one protective member is positioned upstream from the at least one stator labyrinth tooth such that a downstream side of the at least one protective member extends across substantially all of the upstream surface of the at least one stator labyrinth tooth to facilitate reducing a flow of combustion gas across the stator labyrinth tooth during rotor operation.

16. A method in accordance with claim 15, wherein coupling at least one protective member to the stator shroud further comprises coupling the at least one protective member that has a downstream side that defines a second height and an upstream side that defines a first height different from the second height, wherein the second height is approximately equal to a height of the stator labyrinth tooth.

17. A method in accordance with claim 15, further comprising:

coupling at least one turbine bucket to a rotor shaft to form the rotor;

coupling at least one rotor labyrinth tooth to the turbine bucket such that the labyrinth tooth extends outwardly from the turbine bucket towards the stator casing; and coupling the stator shroud to the stator casing such that the at least one stator labyrinth tooth is oriented with respect to the rotor labyrinth tooth to form a tortuous gas path therebetween.

18. A sealing assembly in accordance with claim 1, wherein said at least one stator labyrinth tooth comprises a first substrate material that has a relatively low oxidation resistance.

19. A rotary machine in accordance with claim 8, wherein said at least one stator labyrinth tooth comprises a first substrate material that has a relatively low oxidation resistance.

20. A method in accordance with claim 15, wherein coupling at least one protective member to the stator shroud further comprises coupling the at least one protective member that comprises a first substrate material that has a relatively low oxidation resistance.

* * * * *